US006878683B2

(12) United States Patent
Neumann et al.

(10) Patent No.: US 6,878,683 B2
(45) Date of Patent: Apr. 12, 2005

(54) POLYMERS USED AS CONTROLLABLE DISPERSING AGENTS

(75) Inventors: Peter Neumann, Mannheim (DE); Werner Bertleff, Viernheim (DE); Matthias Kroner, Eisenberg (DE); Bernard Mohr, Heidelberg (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 294 days.

(21) Appl. No.: 10/297,490

(22) PCT Filed: Jun. 6, 2001

(86) PCT No.: PCT/EP01/06394

§ 371 (c)(1),
(2), (4) Date: Dec. 9, 2002

(87) PCT Pub. No.: WO01/94518

PCT Pub. Date: Dec. 13, 2001

(65) Prior Publication Data

US 2003/0148915 A1 Aug. 7, 2003

(30) Foreign Application Priority Data

Jun. 9, 2000 (DE) ..... 100 28 216

(51) Int. Cl.[7] ..... C11D 3/37; C11D 11/00

(52) U.S. Cl. ..... 510/476; 510/356; 510/360; 510/361; 510/434; 510/477; 562/512

(58) Field of Search ..... 510/356, 360, 510/361, 434, 476, 477; 562/512

(56) References Cited

U.S. PATENT DOCUMENTS 6,756,471 B1 * 6/2004 Kroner et al. ..... 528/271

2003/0148915 A1 * 8/2003 Neumann et al. ..... 510/475

FOREIGN PATENT DOCUMENTS

| | | | | |
|---|---|---|---|---|
| DE | 44 35 743 | | 8/1995 | |
| DE | 196 53 524 | | 6/1998 | |
| EP | 0 324 568 | | 7/1989 | |
| EP | 324568 | * | 7/1989 | ..... C08F/220/00 |
| EP | 0 754 712 | | 1/1997 | |
| WO | 97 45512 | | 12/1997 | |

* cited by examiner

*Primary Examiner*—Brian P. Mruk
(74) *Attorney, Agent, or Firm*—Oblon, Spivak, McClelland, Maier & Neustadt, P.C.

(57) ABSTRACT

Polymers of a poly(meth)acrylic acid main chain in which, based on the main chain, 0 to 30% by weight of the (meth)acrylic acid basic building blocks may be replaced by maleic acid (anhydride) basic building blocks, fumaric acid basic building blocks or mixtures thereof and 0 to 10% by weight of the (meth)acrylic acid basic building blocks may be replaced by other copolymerizable ethylenic basic building blocks, and $C_{1-30}$-alkylpoly-$C_{2-4}$-alkylene glycols, bonded to the main chain via ester groups, having an average molecular weight of from 250 to 10 000 as side chains, where, based on the polymer, 1 to 19% by weight of the main chain and 81 to 99% by weight of the side chains are present and this ratio and the average molecular weight of the side chains are chosen such that free carboxyl groups are present in the polymer, are used as controllable dispersants for detergents or cleaners or constituents thereof.

9 Claims, No Drawings

POLYMERS USED AS CONTROLLABLE DISPERSING AGENTS

The invention relates to the use of certain polymers as controllable dispersants for detergents or cleaners or constituents thereof.

It is known to use water-soluble polymers in detergent and cleaner compositions, said polymers acting as builders, lime soap dispersants or as incrustation inhibitors. EP-A-0 324 568 describes polymers of this type. These are copolymers of (meth)acrylic acid and alkylpolyethylene glycol (meth)acrylates. The proportion by weight of alkylpolyalkylene glycols is 4 to 80% by weight, and the proportion of unsaturated carboxylic acids is 20 to 95% by weight. In addition, 0 to 30% by weight of other comonomers can be used. The copolymers described in the examples comprise approximately 10 to 30% by weight of the alkylpolyalkylene glycols copolymerized in an ester-like manner.

As a result of the large proportions of copolymerized carboxylic acids, the polymers according to the prior art have charge densities which are too high. Such polymers are incompatible with the detergent constituents, phase separations arise and the polymers according to the prior art therefore do not have a dispersing action either. Polymers which contain no carboxyl groups can likewise not be used for this purpose since they do not have dispersing properties. Effective polymers must show an affinity to the material to be dispersed.

It is an object of the present invention to provide polymers which can be used as dispersants in detergents and cleaners and constituents thereof. They should preferably exhibit a controllable dispersion behavior.

We have found that this object is achieved according to the invention by the use of polymers of a poly(meth)acrylic acid main chain in which, based on the main chain, 0 to 30% by weight of the (meth)acrylic acid basic building blocks may be replaced by maleic acid (anhydride) basic building blocks or fumaric acid basic building blocks or mixtures thereof and 0 to 10% by weight of the (meth)acrylic acid basic building blocks may be replaced by other copolymerizable ethylenic basic building blocks, and $C_{1-30}$-alkylpoly-$C_{2-4}$-alkylene glycols, bonded to the main chain via ester groups, having an average molecular weight of from 250 to 10 000 as side chains, where, based on the polymer, 1 to 19% by weight of the main chain and 81 to 99% by weight of the side chains are present and this ratio and the average molecular weight of the side chains are chosen such that free carboxyl groups are present in the polymer, as controllable dispersants for detergents or cleaners or constituents thereof.

Here, the expressions poly(meth)acrylic acid mixture(s) (meth)acrylic acid mean monomers or polymers of acrylic acid, methacrylic acid or mixture(s) thereof. The corresponding applies for the expression maleic anhydride. It covers maleic acid, maleic anhydride and mixtures thereof.

The free carboxyl groups present in the polymer can be in protonated form as free acid groups or in neutralized form. Here, they can, in particular, be neutralized with ammonium, alkaline earth metal or alkali metal ions. In particular, some or all of the carboxyl groups are present in sodium or potassium salt form. The calculation of the proportions by weight is based on the free carboxyl groups.

Unless stated otherwise, the average molecular weights are based on the weight average of the molecular weight.

Monomers which may be used for the main chain are acrylic acid, methacrylic acid, where appropriate additionally fumaric acid, maleic acid or maleic anhydride. The proportion of the maleic acid (anhydride) basic building blocks, fumaric acid basic building blocks or mixtures thereof is 0 to 10% by weight. The main chain can also be free from these comonomers. In addition, 0 to 10% by weight, preferably 0 to 5% by weight of the (meth)acrylic acid basic building blocks can be replaced by other copolymerizable ethylenic basic building blocks. It is also possible that no such basic building blocks are present. Examples are esters of (meth)acrylic acid, such as methyl (meth)acrylate, butyl acrylate, ethylhexyl acrylate, styrene, acrylamide, lauryl acrylate, hydroxypropyl acrylate, hydroxyethyl methacrylate and N-vinylpyrrolidone. Preferably, no further basic building blocks of this type are present.

If acrylic acid and methacrylic acid basic building blocks are used, then their ratio can be varied within wide limits. It is also possible that only acrylic acid or methacrylic acid is present as basic building blocks in the main chain.

Preferably, the poly(meth)acrylic acid main chain is made up of (meth)acrylic acid basic building blocks and 0 to 10% by weight of maleic acid (anhydride) basic building blocks.

The $C_{1-30}$-alkylpoly-$C_{2-4}$-alkylene glycols are present in the polymers according to the invention in copolymerized form, in the form of acrylic esters, methacrylic esters or fumaric mono- or diesters or maleic mono- or diesters.

The alkylpolyalkylene glycols have $C_1$–$C_{30}$-alkyl groups, such as, for example, methyl, ethyl, propyl, isopropyl, n-butyl, sec-butyl, tert-butyl, hexyl, decyl, dodecyl, isotridecyl, octadecyl, stearyl or oleyl group. The alkyl groups may be linear or branched, and may be saturated or unsaturated. Preferred groups are $C_{1-6}$-alkyl groups, particular preference being given to the methyl group.

Per alkyl group, 1 to 200 alkylene oxide groups, preferably 1 to 50 alkylene oxide groups may be present in added form. The alkylene oxides used may be ethylene oxide, propylene oxide or butylene oxide. The mixing ratio of the alkylene oxides is arbitrary. The various alkylene oxides can be linked randomly or blockwise. The preferred alkylene oxide is ethylene oxide. The alkylpolyalkylene glycols can be prepared by all known alkoxylation methods known to the person skilled in the art. The alkylpolyalkylene glycols can also be referred to as polyalkylene glycol monoalkyl ethers.

As side chains, preference is given to using $C_{1-6}$-alkylpolyethylene glycols, in particular methylpolyethylene glycols.

The average molecular weight of the side chains is 250 to 10 000, preferably 500 to 2000, in particular 750 to 1500.

Preferably, 5 to 15% by weight of the main chain and 85 to 95% by weight of the side chains are present in the polymer.

The polymers used according to the invention are known per se. DE-A-196 53 524 describes the use of such polymers as additives in mineral construction materials. This patent describes polymers which can be used according to the invention, and also processes for their preparation. In addition to the above preparation processes, it is also possible to carry out the preparation processes for the polymers described in DE-A-196 53 524 and EP-A-0 324 568.

The reactive dispersants according to the invention have two different molecular segments, carboxylates (A) and alkylpolyalkylene glycols (B). Without being tied to this theory, the mode of action may be explained as follows:

The molecular units A have adsorbing properties, i.e. as a result of the interaction of the molecular unit A in the polymer with the particle surface, the polymer is adsorbed to its surface. Depending on the pH of the medium, the molecular units A are carboxylic acids or carboxylate groups.

The molecular units B of the polymers have desorbing properties. This means that these units do not interact, or interact only slightly, with the particle surface. These molecular units are solvated by water and draw the polymer molecule away from the particle surface back into the aqueous solution. This is equivalent to a dilution effect. The units of group B used are polyalkylene glycol units.

Two forces act upon the polymer: an adsorbing force and a desorbing force, which are balanced during use.

The adsorbing force can be increased during use by increasing the number of adsorbing groups or by decreasing the number of desorbing groups. The alkylpolyalkylene units are reduced by chemical cleavage reactions in which the groups are removed from the polymer molecule. Since in detergents the pH is in most cases above 7, such a cleavage reaction may arise as a result of alkaline hydrolysis of the ester bonds. As a result, the alkylpolyalkylene glycols are cleaved off from the polymers according to the invention, one ester group producing one carboxylic acid or one carboxylate group. If such a hydrolysis reaction takes place, then the number of carboxylic acid groups increases during use, while the number of alkylpolyalkylene oxide side chains in polymers according to the invention is reduced. By changing the adsorbing and desorbing molecular units during use, the dispersing properties of the polymers are changed during use over the course of time. This property may also be referred to as time-controlled or controllable dispersants (dispersing power which varies with pH).

The changes in the dispersing behavior have an effect, for example, on the crystallization behavior of inorganic or organic particles or crystals. Furthermore, the viscosity of solids suspensions of organic or inorganic solids can be influenced in a targeted manner as a result of programmable reactivity with regard to the cleavage of the alkylpolyalkylene glycol groups. For example, it is possible that, over the course of use, the viscosity of a solids slurry increases, decreases, passes through a maximum or remains constant. This behavior can be adjusted in a targeted manner by the simultaneous use of two or more dispersants of differing reactivity.

The expression "slurry" here means an aqueous suspension or dispersion of detergent or cleaner ingredients, where at least one ingredient is present not in dissolved form, but in dispersed form. Thus, some of the ingredients may be present in dissolved form and some of the ingredients may be present in dispersed form. In particular, slurry means an aqueous mixture of the constituents of detergents and cleaners produced during the preparation of solid detergents and cleaners in order to mix the ingredients as thoroughly as possible.

A particular case exists when a crystallization process also takes place during the dispersion. The adsorbed parts of the polymer grow into the crystal lattice of the solid and are lost from the dispersion. In this case, the effectiveness is lost with advancing time since the polymer is consumed. In this case, it is advantageous if new dispersion-active polymer is continuously reformed. This can be effected by continually cleaving off desorbing groups from reactive polymers present.

For example, it is possible to use a mixture of two dispersants in which one dispersant has no reactivity while the other dispersant has high reactivity with regard to the cleaving off of the desorbing molecular units. As a result of the overlapping of the two different polymers, the viscosity of a solids suspension will decrease during use.

By suitably combining the polymers according to the invention it is also possible to combine such effects in one polymer. Varying reactivity can be incorporated into one polymer molecule by, for example, bonding the desorbing groups firstly strongly reactively and then unreactively or less reactively. During use, the particularly reactively bonded groups can be cleaved off, while the nonreactively bonded groups are retained. Such a differentiation can be achieved, for example, by the alkylpolyalkylene glycol units being present bonded in ester-like manner to copolymerized methacrylic acid, acrylic acid, fumaric mono- or diesters or maleic mono- or diesters. The esters have varying susceptibilities toward hydrolysis. Those most susceptible to hydrolysis are, e.g. in the case of a high pH, acrylic esters, fumaric diesters and maleic diesters, while methacrylic esters, fumaric monoesters or maleic monoesters have a lower susceptibility to hydrolysis. They are cleaved off again at various rates depending on whether the alkylpolyalkylene glycols are bonded in ester-like manner to acrylic acid, methacrylic acid, fumaric acid or maleic acid. Where the conditions of the surrounding environment are different, the order of reactivity may change, so that e.g. methacrylic esters are cleaved more quickly than acrylic esters or maleic monoesters.

If the polymers according to the invention are used as dispersants for the preparation of solids suspensions, then, depending on the composition of the polymers, the viscosity can remain constant, or increase or decrease over the course of use. It is also possible that, during use, a minimum or maximum viscosity may arise, when firstly the viscosity increases and then decreases again, or vice versa. Such maxima or minima mostly occur when two or more effects overlap.

The polymers according to the invention can be prepared in various ways using free-radical polymerization initiators and, where necessary, regulators. Two methods are described below by way of example.

The molecular weights of the polymers according to the invention are preferably between 1000 and 200 000.

Method 1:

Firstly, by polymerizing acrylic acid, methacrylic acid and optionally fumaric acid, maleic acid or maleic anhydride, a homo- or copolymer is prepared which has a molecular weight between 1000 and 100 000. The polycarboxylic acids can be prepared by all known methods of solution, bulk, precipitation or emulsion polymerization. In the subsequent step, 1 to 19% by weight of the polycarboxylic acids are esterified with 81 to 99% by weight of alkylpolyalkylene glycols by known methods in the form of a polymer-analogous reaction.

For example, it is possible to prepare a homopolymer comprising 10 parts of acrylic acid having a molecular weight of 5000, and to esterify the polymer with 90 parts of methylpolyethylene glycol of molar mass 1000.

For example, it is possible to prepare a homopolymer comprising 19 parts of methacrylic acid having a molecular weight of 10 000, and to esterify the polymer with 81 parts of methylpolyethylene glycol of molar mass 1500.

For example, it is possible to prepare a copolymer comprising 10 parts of acrylic acid and 9 parts of methacrylic acid and having a molecular weight of 3000, and to esterify the polymer with 81 parts of methylpolyethylene glycol of molar mass 750.

For example, it is possible to prepare a polymer comprising 5 parts of acrylic acid, 5 parts of methacrylic acid and 5 parts of maleic anhydride and having a molecular weight of 15 000, and to esterify the polymer with 85 parts of methylpolyethylene glycol of molar mass 1000.

The polymers according to the invention can, where appropriate, be converted to an aqueous solution with water and be neutralized as alkali metal salt or alkaline earth metal salt or ammonium salt.

Method 2:

In another embodiment for the preparation of polymers according to the invention, an ester of the unsaturated carboxylic acids with the alkylpolyalkylene glycols is firstly prepared, and these esters are free-radically copolymerized with unsaturated carboxylic acids.

1 to 19% by weight of acrylic acid, methacrylic acid, mixtures thereof and optionally fumaric acid, maleic acid or maleic anhydride are esterified with 81 to 99% by weight of alkylpolyalkylene glycol, and the resulting esters are polymerized using the customary and known methods of bulk, solution, emulsion or precipitation polymerization. Preference is given to preparing an aqueous solution. If necessary, the neutralized alkali metal, alkaline earth metal or ammonium salt form may be prepared.

For example, an esterification product can be prepared from 10 parts of acrylic acid and 81 parts of methylpolyethylene glycol with a molar mass of 1000, which product is then copolymerized with 9 parts of acrylic acid.

For example, an esterification product can be prepared from 19 parts of acrylic acid and 81 parts of methylpolyethylene glycol with a molar mass of 1000 and polymerized.

For example, an esterification product can be prepared from 10 parts of acrylic acid and 81 parts of methylpolyethylene glycol with a molar mass of 1000 and then copolymerized with 9 parts of methacrylic acid.

For example, an esterification product can be prepared from 10 parts of acrylic acid, 9 parts of methacrylic acid and 81 parts of methylpolyethylene glycol with a molar mass of 1000 and then polymerized.

The polymers according to the invention are not subject to any limitations with regard to the preparation methods. The person skilled in the art knows the details and different variations of free-radical polymerizations and esterifications, meaning that details do not have to be given here.

The polymers used according to the invention are preferably used in slurries of detergent or cleaner constituents in the preparation of solid detergents or cleaners. Here, they serve, in particular, to reduce the viscosity of the slurry.

The invention also provides detergents or cleaners comprising at least one surfactant, at least one builder and, based on the detergent or cleaner, 0.2 to 10% by weight of at least one polymer as described above.

Further ingredients and their amounts are described, for example, in EP-A-0669958 and the literature cited therein.

The invention also provides a process for the preparation of solid detergents or cleaners by mixing at least one surfactant, at least one builder and optionally further customary ingredients with water to give a slurry and subsequently drying the slurry, the mixing being carried out in the presence of from 0.2 to 10% by weight, based on the solid ingredients of the detergent or cleaner, of at least one polymer as described above.

The invention is described in more detail below with reference to examples.

EXAMPLES

The following polymers can be prepared by method 1, method 2 or another method:

| Proportion of unsaturated carboxylic acid copolymerized in the polymer according to the invention (% by weight) | Proportion of alkylpolyalkylene glycol in the polymer according to the invention (% by weight) | Molecular weight of the polymer according to the invention (weight-average) |
|---|---|---|
| 10 of acrylic acid | 90 of methylpolyethylene glycol molecular weight 1500 | 20 000 |
| 1 of acrylic acid | 99 of methylpolyethylene glycol molecular weight 8000 | 12 000 |
| 19 of acrylic acid | 81 of methylpolyethylene glycol molecular weight 1000 | 25 000 |
| 10 of methacrylic acid | 90 of methylpolyethylene glycol molecular weight 1000 | 15 000 |
| 15 of methacrylic acid | 85 of methylpolyethylene glycol molecular weight 1000 | 20 000 |
| 5 of methacrylic acid | 85 of methylpolyethylene glycol molecular weight 5000 | 25 000 |
| 7 of acrylic acid and 8 of methacrylic acid | 85 of methylpolyethylene glycol molecular weight 750 | 30 000 |
| 1 of acrylic acid and 18 of methacrylic acid | 81 of methylpolyethylene glycol molecular weight 750 | 40 000 |
| 10 of acrylic acid and 5 of methacrylic acid | 85 of methylpolyethylene glycol molecular weight 2000 | 30 000 |
| 5 of acrylic acid, 8 of methacrylic acid and 5 of maleic acid | 82 of methylpolyethylene glycol molecular weight 750 | 50 000 |
| 10 of acrylic acid, 4 of methacrylic acid and 3 of maleic anhydride | 83 of methylpolyethylene glycol molecular weight 5000 | 30 000 |

Applications-Related Part

During the preparation of detergents, up to 15 individual components in sometimes very different quantitative ratios have to be homogenized as intensively and as uniformly as possible. This is made more difficult by the fact that surfactants produce high-viscosity mixtures upon contact with water. Solids suspensions, such as of zeolites, also form high-viscosity slurries. The auxiliaries for the preparation of the detergents must greatly reduce the viscosity of the detergent components so that, in the crutcher, a slurry with the lowest possible content of water can be prepared which, finally, in other drying devices, is dewatered again, dried and formulated, producing a handleable detergent.

Because of the high proportions of more than 20% by weight of copolymerized carboxylic acids, the polymers according to the prior art have charge densities which are too high. Such polymers are incompatible with the detergent constituents and therefore do not have a dispersing effect on an aqueous slurry either. Polymers which contain no carboxyl groups, i.e. consist of a homopolymer of polyalkylene glycol monoacrylates, can likewise not be used for this purpose since they have no dispersing properties.

Owing to their viscosity-reducing effect, the polymers to be used according to the invention are important auxiliaries in the preparation of reduced-phosphate and phosphate-free detergents and cleaners. By using these auxiliaries it is possible to increase the slurry concentration in the crutcher to at least 80% by weight. This signifies better efficiency as a result of better utilization of the spray tower, and also a saving of energy because less water has to be evaporated. The homogenizing and viscosity-reducing effect of the polymers to be used according to the invention is illustrated by viscosity measurements on detergent formulations. As detergent slurry, use is made, at 60° C., of a suspension of 80% by weight of detergent constituents and 18% by weight of water. A polymer with a molecular weight (weight-average) of 24 500, which had been prepared as the aqueous sodium salt solution by esterification of 85% by weight of methylpolyethylene glycol with a molar mass of 1000 with 10% by weight of acrylic acid and 5% by weight of methacrylic acid and subsequent polymerization and neutralization, was added in an amount of 2% by weight (solid/solid) to the detergent slurry.

The detergent for the preparation of the slurry had the following composition:

10% by weight of dodecylbenzenesulfonate as Na salt
6% by weight of addition product of 7 mol of ethylene oxide with 1 mol of C13/15-oxo alcohol
30% by weight of zeolite A
10% by weight of soda
5% by weight of sodium metasilicate
39% by weight of sodium sulfate The polymer reduces the viscosity of the detergent slurry from 30 000 mPas (without additive) after 10 minutes to 10 000 mPas, after 20 minutes to 5000 mPas and after 50 minutes to 2000 mPas.

As this example shows, polymers according to the invention are effective agents for the preparation of detergents.

We claim:

1. A method for controlling the dispersion of a detergent or cleaner comprising adding to detergent or cleaner ingredients a polymer containing a poly(meth)acrylic acid main chain in which, based on the main chain, 0 to 30% by weight of the (meth)acrylic acid basic building blocks may be replaced by maleic acid (anhydride) basic building blocks or fumaric acid basic building block or mixtures thereof and 0 to 10% by weight of the (meth)acrylic acid basic building blocks may be replaced by other copolymerizable ethylenic basic building blocks.

and $C_{1-30}$-alkylpoly-$C_{2-4}$-alkylene glycols, bonded to the main chain via ester groups, having an average molecular weight of from 250 to 10 000 as side chains, where, based on the polymer, 1 to 19% by weight of the main chain and 81 to 99% by weight of the side chains are present and this ratio and the average molecular weight of the side chains are chosen such that free carboxyl groups are present in the polymer.

2. The method as claimed in claim 1, wherein 5 to 15% by weight of the main chain and 85 to 95% by weight of the side chains are present in the polymer.

3. The method as claimed in claim 1, wherein the average molecular weight of the side chains is 500 to 2000.

4. The method as claimed in claim 1, wherein the poly (meth)acrylic acid chain is made up of (meth)acrylic acid basic building blocks and 0 to 10% by weight of maleic acid (anhydride) basic building blocks.

5. The method as claimed in claim 1, wherein the side chains used are $C_{1-6}$-alkylpolyethylene glycols.

6. The method as claimed in claim 1, which is performed in slurries of detergent constituents in the preparation of solid detergents.

7. The method as claimed in claim 6, which is performed for reducing the viscosity of the slurry.

8. A detergent or cleaner comprising at least one surfactant, at least one builder and, based on the detergent or cleaner, 0.2 to 10% by weight of at least one polymer as defined in claim 1.

9. A process for the preparation of solid detergents or cleaners by mixing at least one surfactant, at least one builder and optionally further customary ingredients with water to give a slurry and subsequently drying the slurry, which comprises carrying out the mixing in the presence of from 0.2 to 10% by weight, based on the solid ingredients of the detergent or cleaner, of at least one polymer as defined in claim 1.

* * * * *